US010411418B2

(12) United States Patent
Schmidt et al.

(10) Patent No.: US 10,411,418 B2
(45) Date of Patent: Sep. 10, 2019

(54) PLUG DEVICE FOR A CABLE, IN PARTICULAR FOR A COAXIAL CABLE, PREFERABLY FOR CONNECTION TO A MUSICAL INSTRUMENT AND/OR SOUND EFFECT EQUIPMENT

(71) Applicant: Hans-Peter Wilfer, Markneukirchen (DE)

(72) Inventors: Roland Schmidt, Heidelberg (DE); Klaus Lackner, Heidelberg (DE)

(73) Assignee: HANS-PETER WILFER, Markneukirchen (DE)

( * ) Notice: Subject to any disclaimer, the term of this patent is extended or adjusted under 35 U.S.C. 154(b) by 0 days.

(21) Appl. No.: 15/838,799

(22) Filed: Dec. 12, 2017

(65) Prior Publication Data

US 2018/0166837 A1 Jun. 14, 2018

(30) Foreign Application Priority Data

Dec. 13, 2016 (DE) ..... 10 2016 124 251

(51) Int. Cl.
*H01R 9/05* (2006.01)
*H01R 24/54* (2011.01)
(Continued)

(52) U.S. Cl.
CPC ..... *H01R 24/545* (2013.01); *G10H 1/0033* (2013.01); *G10H 1/32* (2013.01);
(Continued)

(58) Field of Classification Search
CPC .. H01R 24/545; H01R 9/0524; H01R 4/5033; H01R 31/06; H01R 13/512;
(Continued)

(56) References Cited

U.S. PATENT DOCUMENTS 5,069,636 A * 12/1991 Shimirak ..... H01R 4/2408 439/412
5,791,919 A * 8/1998 Brisson ..... H01R 27/00 439/166

(Continued)

FOREIGN PATENT DOCUMENTS

| | | | |
|---|---|---|---|
| DE | 000010233890 | B4 | 3/2005 |
| DE | 202013104759 | U1 | 1/2014 |
| DE | 102013007815 | A1 | 11/2014 |
| DE | 102011112682 | B4 | 9/2015 |
| WO | 2015/045032 | A1 † | 4/2015 |

OTHER PUBLICATIONS

Website: D'addario Planet Waves PW-MS-10 Custom Series Microphone Cable—10', with Swivel XLR (https://sweetwater.com/store/detail/PWCBMic10—daddario-planet-waves-pw-ms-10-custom-series-microphone-cable-10-foot-with-swivel-xlr-connectors).

*Primary Examiner* — Jean F Duverne
(74) *Attorney, Agent, or Firm* — Scarinci Hollenbeck, LLC; Libby Babu Varghese

(57) ABSTRACT

The invention relates to a plug device for a cable, in particular for a coaxial cable, preferably for connection to a musical instrument and/or sound effect equipment, in particular a pedalboard, comprising: a distal connecting piece, in particular a pin, for connecting the plug device to a corresponding connecting piece, in particular a socket, of a device to be connected to the cable, in particular the musical instrument and/or the sound effect equipment, a proximal connecting piece for receiving the cable and an orientation adjustment device for changing an orientation of the proximal connecting piece relative to the distal connecting piece.

9 Claims, 6 Drawing Sheets

(51) Int. Cl.

| | |
|---|---|
| ***G10H 1/32*** | (2006.01) |
| ***G10H 1/00*** | (2006.01) |
| *H01R 13/512* | (2006.01) |
| *H01R 24/58* | (2011.01) |
| *H01R 43/20* | (2006.01) |
| *H01R 103/00* | (2006.01) |

(52) U.S. Cl.
CPC ..... *H01R 13/512* (2013.01); *H01R 24/58* (2013.01); *H01R 43/20* (2013.01); *H01R 2103/00* (2013.01)

(58) Field of Classification Search
CPC .... H01R 13/518; H01R 27/00; H01R 4/2408; H01R 2103/00; H01R 43/20; H01R 24/58; G10H 1/0033; G10H 1/32
USPC ..... 439/582
See application file for complete search history.

(56) References Cited

U.S. PATENT DOCUMENTS

| | | | | |
|---|---|---|---|---|
| 5,860,824 | A | 1/1999 | Fan | |
| 6,149,469 | A * | 11/2000 | Kim | H01R 31/06 439/218 |
| 6,428,351 | B1 * | 8/2002 | Turner | H01R 13/518 439/540.1 |
| 6,705,884 | B1 † | 3/2004 | McCarthy | |
| 6,848,934 | B1 * | 2/2005 | McCarthy | H01R 4/5033 439/427 |
| 7,785,133 | B2 * | 8/2010 | Wajcman | H01R 9/0524 439/412 |
| 8,183,455 | B2 * | 5/2012 | Armstrong | G10H 1/46 84/737 |
| 9,279,951 | B2 * | 3/2016 | McGranahan | G02B 6/4453 |

* cited by examiner
† cited by third party

PLUG DEVICE FOR A CABLE, IN PARTICULAR FOR A COAXIAL CABLE, PREFERABLY FOR CONNECTION TO A MUSICAL INSTRUMENT AND/OR SOUND EFFECT EQUIPMENT

This application claims priority to foreign German application DE102016124251.9 filed on Dec. 13, 2016.

BACKGROUND

The invention relates to a plug device for a cable, in particular for a coaxial cable, preferably for connection to a musical instrument and/or sound effect equipment, in particular a pedalboard, and to a method for adjusting the plug device.

A plug for receiving a distal end of a coaxial cable for the transmission of audio signals and the like is known, for example, from U.S. Pat. No. 7,785,133 B2. A plug is described there, which allows the cable to be accommodated either in a straight line or at an angle of 90°. The angled accommodation is made possible by an opening on a circumferential surface of the plug, which is provided in addition to an opening into which the cable can be inserted with the desired straight line orientation. With regard to handling and robustness, the solution according to U.S. Pat. No. 7,785,133 B2 is seen as being in need of improvement.

The task of the invention is therefore to propose a plug device for a cable, in particular for a coaxial cable, preferably for connection to a musical instrument and/or sound effect, equipment, in particular a pedalboard, in which a simple and reliable connection, in particular for changing external conditions, is made possible.

BRIEF SUMMARY OF THE INVENTION

This task is solved by the features of claim 1. The task is solved in particular by a plug device for a cable, in particular for a coaxial cable, preferably for connection to a musical instrument and/or sound effect equipment, in particular a pedalboard, wherein the plug device comprises: a distal connecting piece, in particular a pin (or comprising a pin), for connecting the plug device to a corresponding connecting piece (in particular a socket) of a device to be connected to the cable, in particular for connecting the plug device to a corresponding connecting piece of the musical instrument and/or the sound effect equipment (in particular pedalboards), a proximal connecting piece for receiving the cable and an orientation adjustment device for changing an orientation of the proximal connecting piece relative to the distal connecting piece.

One core concept of the invention lies in configuring the plug device in such a way that it can be adjusted depending on the desired cable routing (for example, parallel or angled). One significant difference to the state of the art according to U.S. Pat. No. 7,785,133 B2 therefore already lies in the fact that there the plug device as such is not changed or adjusted when the cable routing direction is changed, in contrast, in the solution according to the invention, the plug device is modified. This simplifies handling. It was inventively in particular recognized, that the use of the solution according to U.S. Pat. No. 7,785,133 B2 assumes that a first user even knows how the different openings for receiving the cable should be used. This can in particular not be provided to the first user by a second user. In the solution according to the invention, on the other hand, the plug device can already be configured by the second user in such a way that the first user (when he uses the plug device) implements (without further refection) the cable routing as desired by the second user. Overall, the handling of the plug device is improved with simple means.

One aspect of the invention also lies in a method for adjusting the above-described plug device (which is specified further below), wherein an orientation of the proximal connecting piece relative to the distal connecting piece is changed. As already described above, here too one concept of the invention already lies in the "adjustment" of the plug device as such.

The task is furthermore also solved by the use of the above (and specified further below) plug device for a cable, in particular for a coaxial cable, preferably for connection to a musical instrument and/or sound effect equipment, in particular a pedalboard.

An angle difference between a first orientation and a second orientation of the proximal connecting piece with respect to the distal connecting piece is preferably at least 20°, more preferably at least 45°, even more preferably at least 80°, in particular (at least approximately) 90°. Furthermore, an angle difference between a (the) first orientation and a (the) second orientation of the proximal connecting piece with respect to the distal connecting piece can be at most 160°, preferably at most 135°, further preferably at most 100°. The orientation adjustment device is preferably configured in such a way that an (at least substantially) parallel orientation of the proximal connecting piece with respect to the distal connecting piece can be set. Alternatively or additionally, the orientation adjustment device can be configured in such a way that an (at least substantially) perpendicular orientation of the proximal connecting piece with respect to the distal connecting piece can be set.

The orientation adjustment device can generally be configured in such a way that multiple (e.g. at least two or exactly two) different orientations of the proximal connecting piece relative to the distal connecting piece can be set. The orientation adjustment device could alternatively also be configured in such a way, that a continuously variable orientation of the proximal connecting piece relative to the distal connecting piece can be set. A discrete adjustment option (e.g. in two different orientations), in particular, facilitates the operation and configuration of the plug device or the system, in which the plug device is used.

A plug-in connection device is preferably provided in such a way that the proximal and the distal connecting piece can be plugged together (preferably in at least two different orientations of the proximal connecting piece with respect to the distal connecting piece). One of the connecting pieces can comprise a corresponding plug receptacle, into which an end section (or a corresponding projection) of the other connecting piece (e.g. the proximal connecting piece) can be inserted. Particularly preferably, the same end section of the one connecting piece (e.g. of the proximal connecting piece) is received in the same plug receptacle of the other receiving piece (e.g. distal connecting piece) in two different orientations. As a result, the plug device can be configured as desired in a simple manner.

The orientation of the proximal connecting piece relative to the distal connecting piece can be ensured by a securing device (in particular a securing screw). Latching devices, e.g. spring-loaded latching devices, could alternatively also be used as the securing device. In any case, an easy-to-operate plug-in device is created.

The proximal connecting piece can be detachable from the distal connecting piece (if necessary completely). It can in particular be made possible for the proximal connecting piece and the distal connecting piece to be detachable from one another, whereby, at the same time, sections of an accommodated cable are still accommodated in the connecting pieces. A change in the orientation is in particular made possible by removing the proximal connecting piece from the distal connecting piece, reorienting it as appropriate (if necessary also rotating it about its own longitudinal axis) and again connecting it to the distal connecting piece. A simple and intuitively producible reorientation can thus be performed.

A change in the orientation of the proximal connecting piece with respect to the distal connecting piece is generally to be understood as a change in the alignment of the proximal connecting piece with respect to the distal connecting piece. This can be achieved in that either the distal connecting piece is at rest and the proximal connecting piece is rotated relative to the distal connecting piece or, vice versa, that the proximal connecting piece is at rest and the distal connecting piece is rotated relative to the proximal connecting piece, or that the proximal connecting piece and the distal connecting piece are simultaneously rotated relative to one another.

The orientation adjustment device is preferably configured in such a way that the proximal connecting piece and/or the distal connecting piece can (in sections) be inserted (plugged) into a recess disposed on the respective other connecting piece in at least two or exactly two different orientations.

The orientation adjustment device is preferably configured in such a way that, in a state in which it is in a first orientation (with respect to the distal connecting piece) relative to a state in which it is in a second orientation (with respect to the distal connecting piece), the proximal connecting piece is rotated about an axis (preferably rotated 180°), which lies parallel to a cable receiving direction, and/or is rotated about an axis (preferably rotated in accordance with the angle between the first orientation and the second orientation, in particular 90°), which lies perpendicular to a cable receiving direction. The cable receiving direction is defined by the direction of movement of the cable end when it is moved into the proximal connecting piece. In the case of a connecting piece with a cylindrical receiving section, this direction then corresponds in particular to the axial direction. Overall, a simple adjustment of the plug device is thus made possible.

The orientation adjustment device is preferably configured in such a way that the orientation is adjusted when the proximal connecting piece is detached from the distal connecting piece (wherein the cable is possibly still accommodated in sections at least in the proximal connecting piece and optionally also in the distal connecting piece), in particular exclusively when the proximal connecting piece is detached from the distal connecting piece. In particular, therefore, it is structurally impossible that an adjustment of the orientation can be performed, when the distal connecting piece and the proximal connecting piece are connected to one another. The likelihood of an unintentional change of the orientation, for example, can thus be prevented as well. This simplifies the handling of the plug device.

The proximal and the distal connecting piece can be fixed in their relative orientation with respect to one another by means of corresponding stops. Preferably, in a first orientation, a first stop surface of the proximal connecting piece is in contact with a first stop surface of the distal connecting piece and, in the second orientation, the first stop surface of the proximal connecting piece is in contact with a second stop surface of the distal connecting piece.

Alternatively or additionally, a first and a second stop surface of the proximal connecting piece can comprise an angle relative to one another, which preferably corresponds to the angle between a first and a second orientation and/or an angle of (at least approximately) 90°.

Alternatively or additionally, a first and a second stop surface of the distal connecting piece can comprise an angle relative to one another, which corresponds to the angle between a first and a second orientation and/or an angle of (at least approximately) 90°. In a specific embodiment, in a (the) first orientation, a first stop surface of the proximal connecting piece is in contact with a first stop surface of the distal connecting piece and, in a (the) orientation, the first stop surface of the proximal connecting piece is in contact with the second stop surface of the distal connecting piece and the first stop surface of the distal connecting piece is in contact with the second stop surface of the proximal connecting piece. Different (in particular exactly two different) orientations can be defined in a simple manner by means of such (corresponding) stops.

A cable guide within the plug device is formed at least in sections by the proximal connecting piece and is preferably additionally formed (at least in sections) by the distal connecting piece. The cable is thus preferably guided both through the proximal connecting piece and into the distal connecting piece. Particularly preferably, the cable can remain within both the proximal connecting piece and the distal connecting piece when the orientation is changed. The handling overall is thus facilitated. In particular, there is less of a risk that the proximal connecting piece will be separated from the distal connecting piece in such a way that one or both connecting pieces get lost (comparable to carelessly putting aside a protective cap of a bicycle valve), wherein, in a simple manner, use is made of the fact that the cable holds the two connecting pieces. This is advantageous in particular for complicated sound effect equipment with a large number of plugs and correspondingly connected cables. Otherwise, the connecting pieces can be detachable from one another (see above), which makes simple reorientation possible.

The orientation adjustment device can be configured in such a way that the adjustment of the orientation can be performed in the (at least partially) inserted state of the cable, in particular in a state, in which the cable is inserted in the distal connecting piece in sections.

The method for adjusting the plug device can comprise steps which correspond to the (in particular the functional) features of the above-described plug device. To change the orientation, the proximal connecting piece can be removed from the distal connecting piece.

Alternatively or additionally, to change the orientation, the proximal connecting piece can be rotated about an axis (preferably rotated 180°), which lies parallel to a cable receiving direction.

Alternatively or additionally, to change the orientation, the proximal connecting piece can be rotated about an axis (preferably rotated in accordance with the angle between a first orientation and a second orientation, in particular 90°), which lies perpendicular to a cable receiving direction.

An (at least substantially) parallel orientation of the proximal connecting piece with respect to the distal connecting piece can be set.

Alternatively or additionally, an (at least substantially) perpendicular orientation of the proximal connecting piece with respect to the distal connecting piece can be set.

The proximal and the distal connecting piece can be plugged together (preferably in at least two different orientations of the proximal connecting piece with respect to the distal connecting piece).

An orientation of the proximal connecting piece (relative to the distal connecting piece) can be secured (or locked).

The proximal connecting piece can be detached from the distal connecting piece (if necessary completely).

The orientation can be adjusted when the proximal connecting piece is detached from the distal connecting piece.

The proximal and the distal connecting piece can be fixed in their relative orientation with respect to one another by means of corresponding stops. Preferably, in a first orientation, a first stop surface of the proximal connecting piece is brought into contact with a first stop surface of the distal connecting piece and, in a second orientation, the second stop surface of the proximal connecting piece is brought into contact with the second stop surface of the distal connecting piece.

The adjustment of the orientation is preferably performed in the at least partially inserted state of the cable, in particular in a state, in which the cable is (also) inserted in the distal connecting piece sections.

The proximal connecting piece preferably comprises a (cylindrical) cavity, which further preferably extends through the entire length of the proximal connecting piece.

Alternatively or additionally, the second connecting piece comprises an (in particular cylindrical) cavity, which further preferably does not extend over the entire length of the distal connecting piece (for example only over 5-50%, preferably 10-40% of the length). A diameter of the receiving space of the proximal connecting piece or the receiving space of the distal connecting piece can be 2-10 mm, preferably 3-5 mm. A length of the proximal connecting piece is preferably less than a length of the distal connecting piece. A length of the proximal connecting piece can be equivalent to a length of the distal connecting piece plus/minus 80%, preferably plus/minus 50%. The length of the proximal connecting piece is preferably 10-90%, further preferably 20-60%, of the length of the distal connecting piece.

The cross section of a distal. (facing the distal connecting piece) end section of the proximal connecting piece can correspond to a circle segment. A proximal end section of the distal connecting piece can likewise have such a cross section. Preferably, however, the proximal end section of the distal connecting piece comprises a receptacle, the cross section of which corresponds to a circle segment (alternatively, the distal end section of the proximal connecting piece can comprise a receptacle with such a cross section). A circle segment should in particular be understood as a partial surface of a circular surface, which is delimited by a circular arc and two (straight) lines.

In general, a proximal section (or part) should be understood to be a section (part), which, in use, is disposed closer to the cable (or further away from the corresponding connecting piece, in particular a socket, of the device to be connected to the cable, in particular the musical instrument and/or the sound effect equipment).

A (total) length of the plug device (e.g. in the maximally extended state or, in particular, in the parallel orientation of the connecting pieces) can be 2-10 cm, preferably 4-6 cm.

The distal connecting piece preferably comprises a pin (plug pin). On its distal end section, the distal connecting piece can comprise an (in particular conical) tip. An annular constriction can adjoin the (in particular conical) tip. An outer wall of the proximal and/or distal connecting piece is preferably configured to (in sections) be cylindrical in shape.

A connecting section between the proximal and the distal connecting piece can be configured to have a circular cross-section, in particular configured to be cylindrical.

The plug device can optionally consist of only four or only three (possibly even only two) components, in particular the proximal connecting piece, the distal connecting piece and, if necessary, the securing device (in particular securing screw) and, if necessary, a cable securing device (securing sleeve). These individual components are preferably formed in one piece, in particular monolithically. This allows the realization of a comparatively simple system.

A further aspect of the invention proposes a method for connecting a cable to the plug device. Wherein the plug device is designed as described above or is configured according to the method described above.

A further aspect of the invention proposes a system, comprising a plug device of the type described above and a cable and/or a device to be connected to the cable, in particular a musical instrument and/or sound effect equipment, in particular a pedalboard.

BRIEF DESCRIPTION OF THE DRAWINGS

The invention is described below on the basis of a design example, which is explained in more detail with reference to the figures.

DETAILED DESCRIPTION OF THE INVENTION

Figure 1:
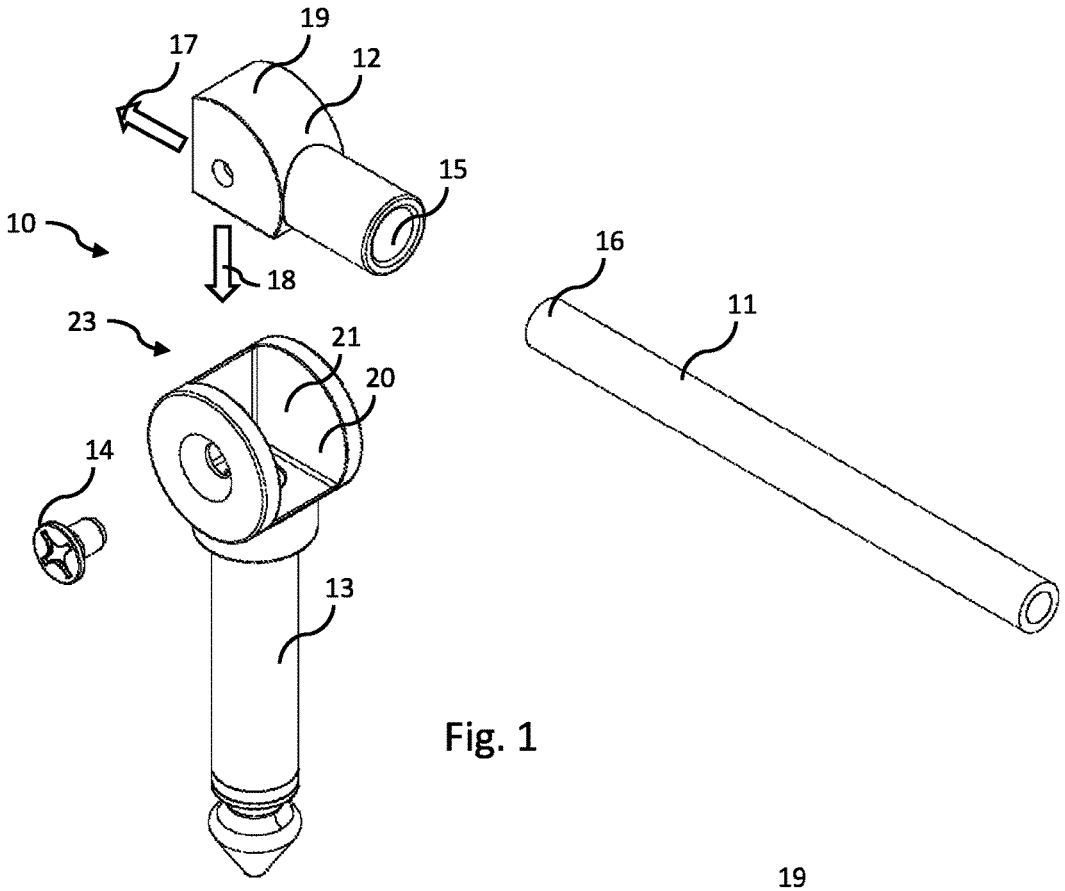
FIG. 1 is a depiction of a system comprising a plug device according to the invention and a cable in a first state.

FIG. 1 shows an exploded view of a system comprising the plug device 10 according to the invention and a cable 11.

The plug device 10 comprises a proximal connecting piece 12, a distal connecting piece 13 and a securing device 14 (securing screw). FIG. 1 furthermore also shows an initial position for a method for connecting the cable 11 to the plug device 10. In accordance with this design, the cable 11 is a coaxial cable.

The proximal connecting piece 12 comprises a cylindrical receptacle 15, through which an end section 16 of the cable 11 can be guided. The end section 16 of the cable 11 can be guided out of the proximal connecting piece 12 either in axial direction according to an arrow 17 or in radial direction according to an arrow 18.

In its cross section, a distal end section 19 corresponds to a circular section (the circumference of which is defined by a section of the circumference line and two inwardly directed lines, which intersect). Viewed spatially, the distal end section 19 is designed as a section of a (circular) cylinder, thus comprising a section of the lateral surface and two surfaces, which intersect in the interior of the (imaginary) overall cylinder.

A proximal end section 20 of the distal connecting piece 13 is designed correspondingly and forms a receptacle 21, which in this case is (preferably) formed by a (circular) cylindrical section. The distal end section 19 of the first connecting piece 12 and the receptacle 21 of the distal connecting piece 13 together form a plug-in connection 27 (see FIG. 2). This plug-in connection 27 allows the connecting pieces to be plugged together in a variety of relative orientations. Furthermore, the distal end section 19 of the first connecting piece 12, the receptacle 21 of the distal connecting piece 13 and the securing device 14 together form an orientation adjustment device 23. This orientation adjustment device 23 allows an adjustment of the relative orientation of the connecting pieces 12, 13.

Figure 2:
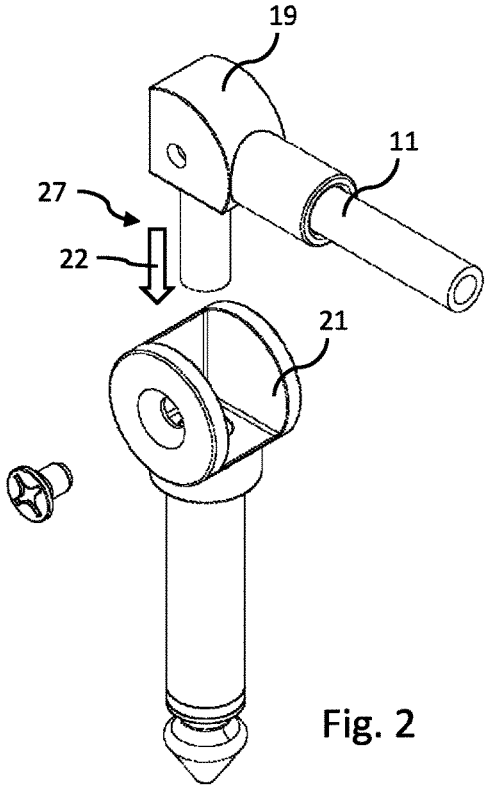
FIG. 2 is a depiction of the system according to FIG. 1 in a second state.
Figure 3:
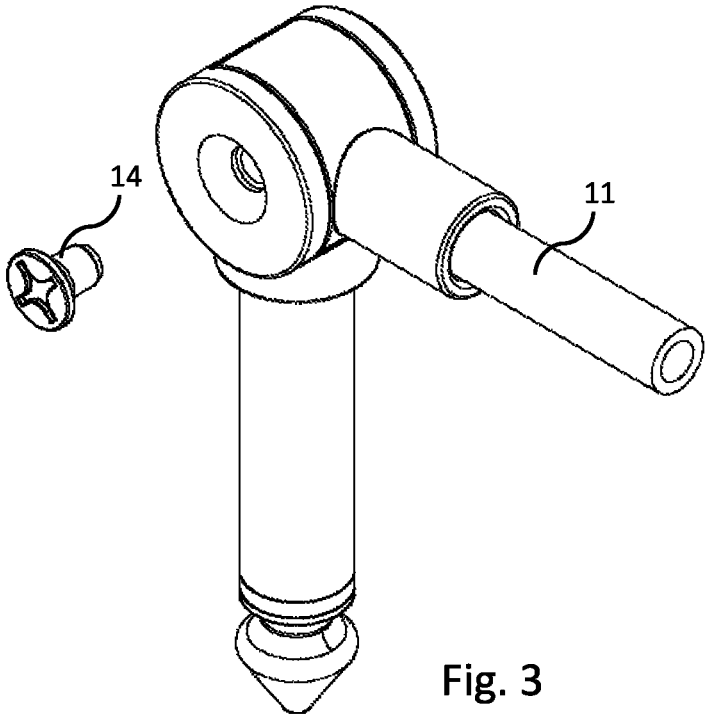
FIG. 3 is a depiction of the system according to FIG. 1 in a third state.

FIG. 2 shows a state in which the cable 11 is already guided through the proximal connecting piece 12, and in such a way that it is guided out of the proximal connecting piece in radial direction (with respect to the proximal connecting piece). If the cable 11 is now moved together with the proximal connecting piece 12 in the direction of the arrow 22 (see FIG. 2), the state according to FIG. 3 is achieved. In this state, the cable 11 is (in sections) accommodated in the proximal connecting piece 12 and in the distal connecting piece 13. This state can now be secured by the securing device 14 (see FIG. 4).

Figure 5:
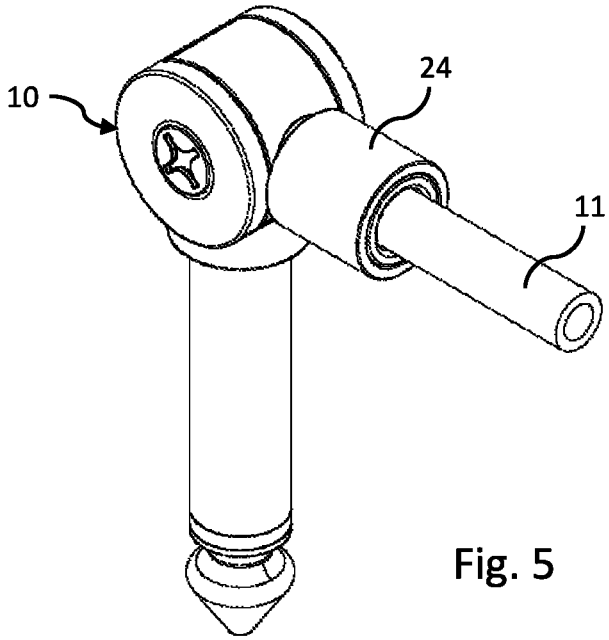
FIG. 5 is a depiction of the system according to FIG. 1 in the state according to FIG. 4 with a securing sleeve.

FIG. 5 additionally shows a securing sleeve 24, which in particular secures the cable 11 in the plug device 10.

Figure 4:
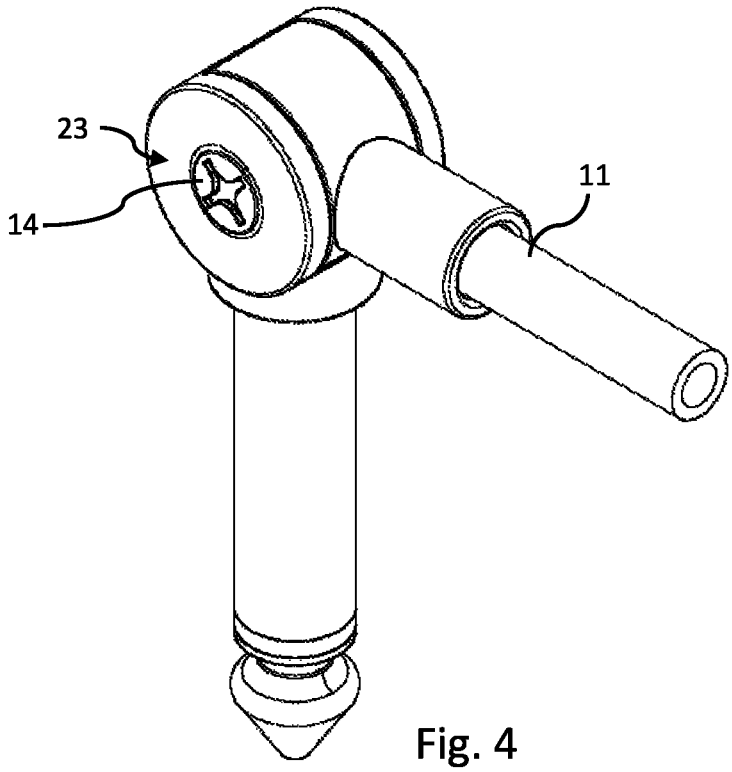
FIG. 4 is a depiction of the system according to FIG. 1 in a fourth state.
Figure 6:
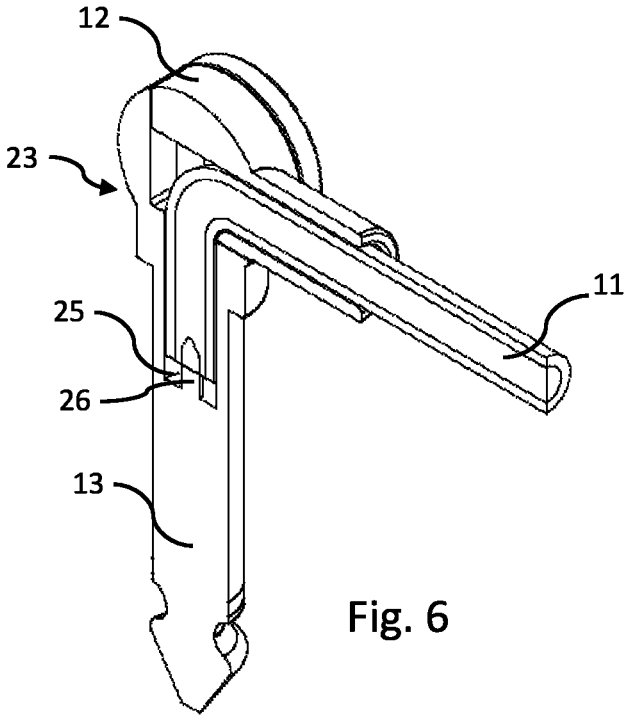
FIG. 6 is a depiction of the system according to FIG. 1 in the state according to FIG. 4 in a sectional oblique view.

FIG. 6 shows a sectional oblique view of the system in the state according to FIG. 4. It can in particular be seen there, that a cable receptacle 25 of the distal connecting piece 13 comprises a pin 26, which is oriented in the direction of the cable 11 and contributes to the positioning of the cable 11.

Figure 7:
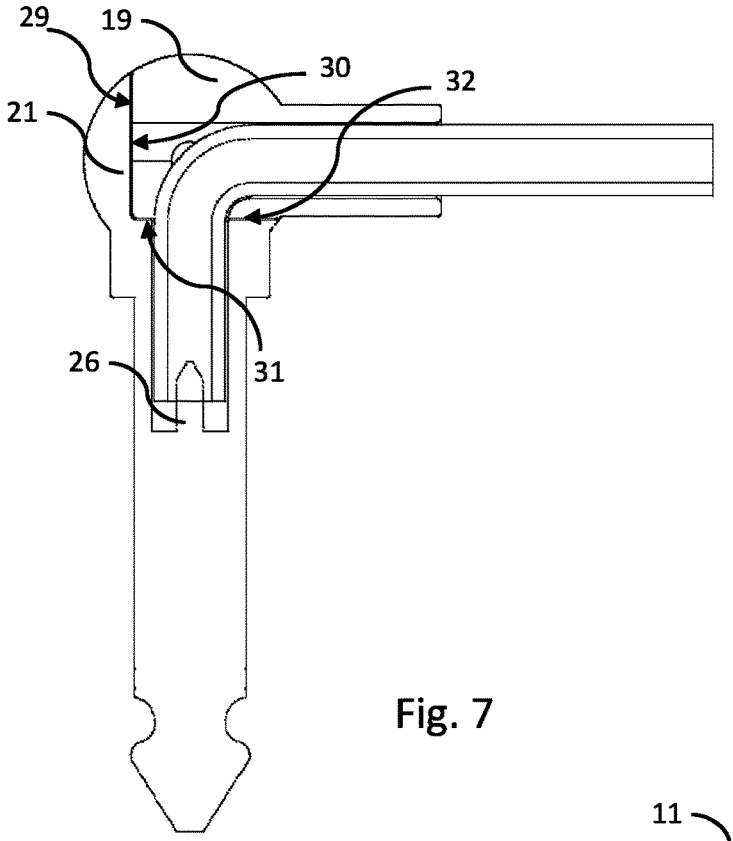
FIG. 7 is a depiction of the system according to FIG. 1 in the state according to FIG. 4 in a sectional view.
Figure 11:
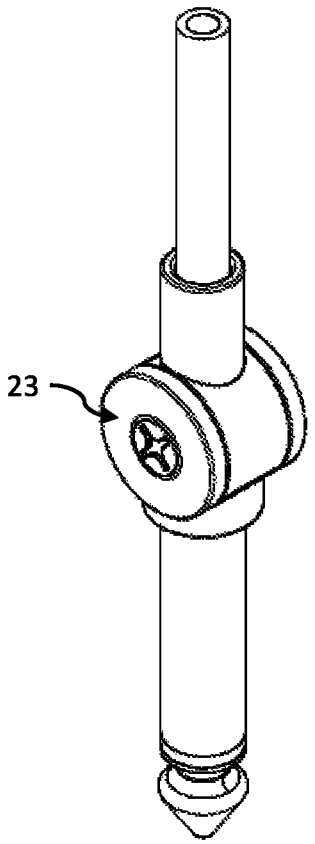
FIG. 11 is a depiction of the system according to FIG. 1 in a further state.
Figure 12:
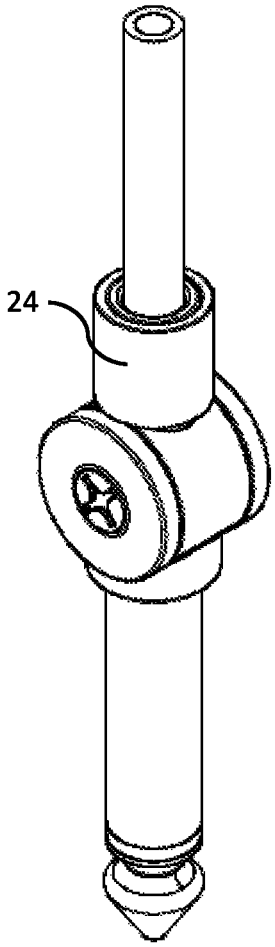
FIG. 12 is a depiction of the system according to FIG. 1 in the state according to FIG. 11 with a securing sleeve.

This can also be seen again in the sectional view according to FIG. 7. FIG. 7 further shows the different stop surfaces of the distal end section 19, the proximal connecting piece 12 and the receptacle 21 of the distal connecting piece 13. The proximal 12 and the distal 13 connecting piece are fixed in their relative orientation with respect to one another by means of the corresponding stops (29 to 32). In the orientation according to FIG. 7, a first stop surface 29 of the proximal connecting piece 12 is in contact with a first stop surface 30 of the distal connecting piece 13. In the orientation according to FIG. 11, the first stop surface 29 of the proximal connecting piece 12 is in contact with a second stop surface 32 of the distal connecting piece 13. The first 29 and the second 31 stop surface of the proximal connecting piece 12 comprise an angle relative to one another, which corresponds to the angle between a first and a second orientation or an angle of at least approximately 90°. The first 30 and the second 32 stop surface of the distal connecting piece 13 likewise comprise an angle relative to one another, which corresponds to the angle between the first and the second orientation or an angle of at least approximately 90°.

FIGS. 8 to 12 show the adjustment or modification (relative to FIGS. 1 to 7) of the orientation of the proximal connecting piece 12 with respect to the distal connecting piece 13.

Figure 8:
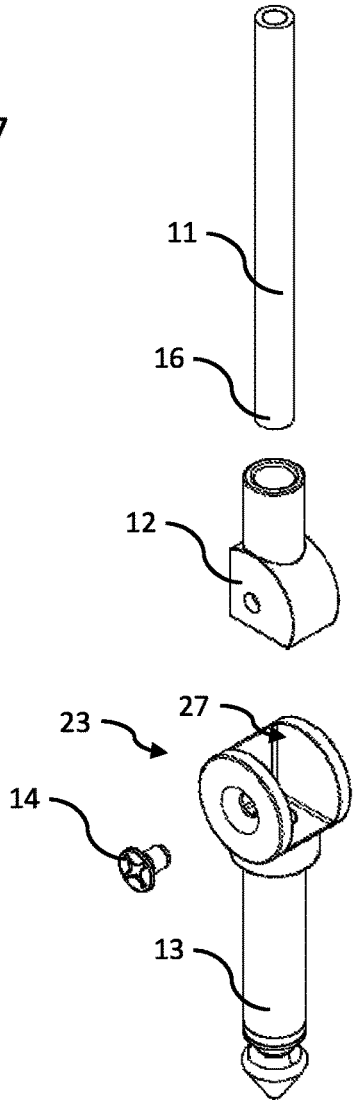
FIG. 8 is a depiction of the system according to FIG. 1 in a further state.
Figure 9:
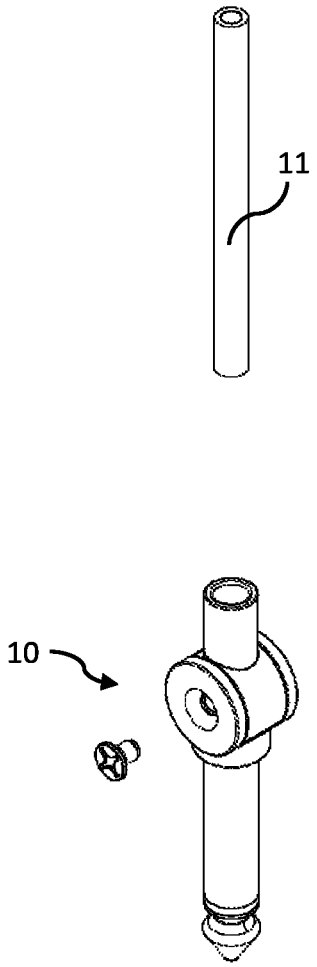
FIG. 9 is a depiction of the system according to FIG. 1 in a further state.

FIG. 8 then shows the initial state, in which the cable 11, the proximal connecting piece 12, the distal connecting piece 13 and the securing device 14 are detached from one another. In contrast to FIG. 1, however, the cable 11 or the end section 16 of the cable is in an orientation parallel to the orientation of the distal connecting piece 13. Furthermore, in contrast to FIG. 1, on one side the proximal connecting piece 12 is tilted by 90° (with respect to an axis, which is perpendicular to the axial direction, defined by the proximal connecting piece) and once again rotated 180° (with respect to an axis, which is parallel to the axial direction). Proceeding from the state according to FIG. 8, the proximal connecting piece 12 can now be inserted into the distal connecting piece 13 (if necessary before the cable 11, as shown in FIG. 9, is guided into the proximal connecting piece 12). The cable 11 (see FIG. 10) is then guided into the proximal connecting piece 12 and also into the distal connecting piece 13. The cable 11 could alternatively also first be inserted into the proximal connecting piece or guided through the proximal connecting piece 12 and then (together with the proximal connecting piece 12) connected to the distal connecting piece 13 or inserted into the distal connecting piece 13.

Figure 10:
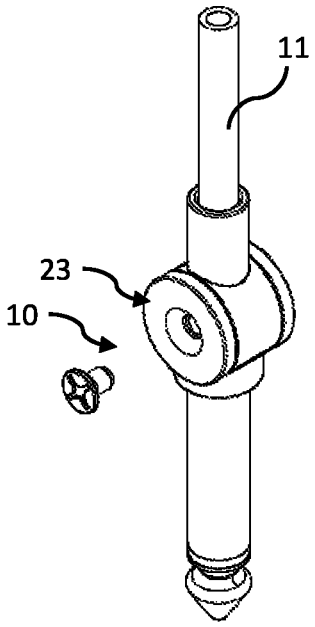
FIG. 10 is a depiction of the system according to FIG. 1 in a further state.

In either case, the result is shown in FIG. 10. According to FIG. 11, the securing device 14 can then secure the proximal and the distal connecting piece relative to one another. This step too could potentially be carried out before the cable 11 is inserted into the plug device. In accordance with FIG. 12, the securing sleeve, which prevents the cable 11 from detaching itself from the plug device, is added (analogous to FIG. 5).

The distal connecting piece and/or the proximal connecting piece are made (at least substantially, in particular at least 50%, preferably at least 80%) of metal. The cable 11 may comprise an (insulating) casing.

At this point, it should be noted that all of the above-described parts, alone and in any combination, in particular the details shown in the drawings, are claimed as essential to the invention. Modifications of these are familiar to the person skilled in the art.

REFERENCE SIGNS

10 plug device,
11 cable,
12 proximal connecting piece,
13 distal connecting piece,
14 securing device,
15 cylindrical receptacle,
16 end section of the cable 11,
17 arrow,
18 arrow,
19 distal end section of the proximal connecting piece 12,
20 proximal end section of the distal connecting piece 13,
21 receptacle,
22 arrow,
23 orientation adjustment device,
24 securing piece,
25 cable receptacle,
26 pin,
27 plug-in connection device,

29 first stop surface of the first connecting piece,
30 first stop surface of the second connecting piece,
31 second stop surface of the first connecting piece, and
32 second stop surface of the second connecting piece.

What is claimed:

1. A plug device for a cable, in particular for a coaxial cable, preferably for connection to a musical instrument and/or sound effect equipment, in particular a pedalboard, comprising:

a distal connecting piece, in particular a pin, for connecting the plug device to a corresponding connecting piece in particular a socket, of a device to be connected to the cable, in particular the musical instrument and/or the sound effect equipment;

a proximal connecting piece for receiving the cable;

an orientation adjustment device for changing an orientation of the proximal connecting piece with respect to the distal connecting piece wherein the orientation adjustment device is configured in such a way that the proximal connecting piece and/or the distal connecting piece can be inserted in sections into a recess disposed on the respective other connecting piece in at least two or exactly two different orientations, wherein the orientation adjustment device is configured in such a way that, in a state in which it is in a first orientation relative to a state in which it is in a second orientation, the proximal connecting piece is rotated about an axis (preferably rotated 180°), which lies parallel to a cable receiving direction, and/or is rotated about an axis (preferably rotated in accordance with the angle between the first orientation and the second orientation, in particular 90°), which lies perpendicular to a cable receiving direction.

2. The plug device according to claim 1, characterized in that an angle difference between a first orientation and a second orientation of the proximal connecting piece with respect to the distal connecting piece is at least 20°, preferably at least 45°, further preferably at least 80°, in particular at least approximately 90°, and/or an angle difference between a first orientation and a second orientation of the proximal connecting piece with respect to the distal connecting piece is at most 160°, preferably at most 135°, further preferably at most 100°.

3. The plug device according to claim 1, characterized in that the orientation adjustment device is configured in such a way that an at least substantially parallel orientation of the proximal connecting piece with respect to the distal connecting piece can be set and/or the orientation adjustment device is configured in such a way that an at least substantially perpendicular orientation of the proximal connecting piece with respect to the distal connecting piece can be set.

4. The plug device according to claim 1, characterized in that the orientation of the proximal connecting piece with respect to the distal connecting piece can be secured by means of said securing device.

5. The plug device according to claim 1, characterized in that the orientation adjustment device is configured in such a way that the adjustment of the orientation is performed when the proximal connecting piece is detached from the distal connecting piece, can in particular be performed exclusively when the proximal connecting piece is detached from the distal connecting piece.

6. The plug device according to claim 1, characterized in that the proximal and the distal connecting piece are fixed in their relative orientation with respect to one another by means of corresponding stops, preferably wherein, in a first orientation, a first stop surface of the proximal connecting piece is in contact with a first stop surface of the distal connecting piece and, in a second orientation, the first stop surface of the proximal connecting piece is in contact with a second stop surface of the distal connecting piece and/or preferably wherein a first and a second stop surface of the proximal connecting piece comprise an angle relative to one another which corresponds to the angle between a first and a second orientation and/or an angle of at least approximately 90° and/or preferably wherein a first and a second stop surface of the distal connecting piece comprise an angle relative to one another which corresponds to the angle between a first and a second orientation and/or an angle of at least approximately 90°.

7. The plug device according to claim 1, characterized in that a cable guide within the plug device is formed at least in sections by the proximal connecting piece and is preferably additionally formed at least in sections by the distal connecting piece.

8. The plug device according to claim 1, characterized in that the orientation adjustment device is configured in such a way that the adjustment of the orientation is implemented in the at least partially inserted state of the cable, in particular in a state in which the cable is inserted in sections into the distal connecting piece.

9. A method for adjusting a plug device comprising changing the orientation of a proximal piece connected to coaxial cable with respect a distal piece for connecting to a socket, the proximal piece and the distal piece each mounted and interconnected within an orientation adjustment device, wherein to change orientation, the proximal connecting piece is removed from the distal connecting piece and/or, to change the orientation, the proximal connecting piece is rotated about an axis (preferably rotated 180°), which lies parallel to a cable receiving direction, and/or rotated about an axis (preferably rotated in accordance with the angle between a first orientation and a second orientation, in particular 90°), which lies perpendicular to a cable receiving direction.

* * * * *